US005704300A

United States Patent [19]

Rushton et al.

[11] Patent Number: 5,704,300

[45] Date of Patent: Jan. 6, 1998

[54] LOAD-HANDLING PALLET AND METHOD OF ASSEMBLY

[76] Inventors: William Joseph Rushton, deceased, late of Whalley; by Edna Winifred Rushton, heiress, 32 Manorfields Manor Road, Whalley Lancashire, both of United Kingdom

[21] Appl. No.: 532,623

[22] PCT Filed: Mar. 31, 1994

[86] PCT No.: PCT/GB94/00692

§ 371 Date: Dec. 8, 1996

§ 102(e) Date: Dec. 8, 1996

[87] PCT Pub. No.: WO94/22728

PCT Pub. Date: Oct. 13, 1994

[30] Foreign Application Priority Data

Apr. 1, 1993 [GB] United Kingdom ..... 9306856.7
Jul. 14, 1993 [GB] United Kingdom ..... 9314575.3

[51] Int. Cl.[6] ..... B65D 19/12

[52] U.S. Cl. ..... 108/56.1; 108/901

[58] Field of Search ..... 108/51.1, 56.1, 108/56.3, 901, 902

[56] References Cited

U.S. PATENT DOCUMENTS

| | | | |
|---|---|---|---|
| 3,664,271 | 5/1972 | Wolder et al. | 108/901 X |
| 3,868,915 | 3/1975 | Hafner | 108/901 X |
| 4,735,154 | 4/1988 | Hemery | 108/56.1 |
| 5,191,843 | 3/1993 | Ausavich et al. | 108/56.1 X |
| 5,329,862 | 7/1994 | Breezer et al. | 108/901 X |
| 5,351,627 | 10/1994 | Junaedi | 108/901 X |
| 5,388,531 | 2/1995 | Crews et al. | 108/56.3 X |
| 5,388,533 | 2/1995 | Pigott et al. | 108/902 X |

FOREIGN PATENT DOCUMENTS

| | | | |
|---|---|---|---|
| 2530588 | 1/1976 | Germany | 108/901 |

*Primary Examiner*—Jose V. Chen
*Attorney, Agent, or Firm*—Madson & Metcalf

[57] ABSTRACT

A load-handling pallet ((10) comprises a plurality of separate plastics elements which are connected together to define an upper-load beating platform (20) with spaced support members (40) therebeneath between which the forks of a forklift truck can be located. The boards (20) forming the platform are mounted on transverse stringers (30) which are in turn secured to the top of blocks (40) by respective locator arrangements (32,41). Base boards (50) are secured to the bottom of the blocks (40) by further respective locator arrangements (52, 57, 152).

7 Claims, 7 Drawing Sheets

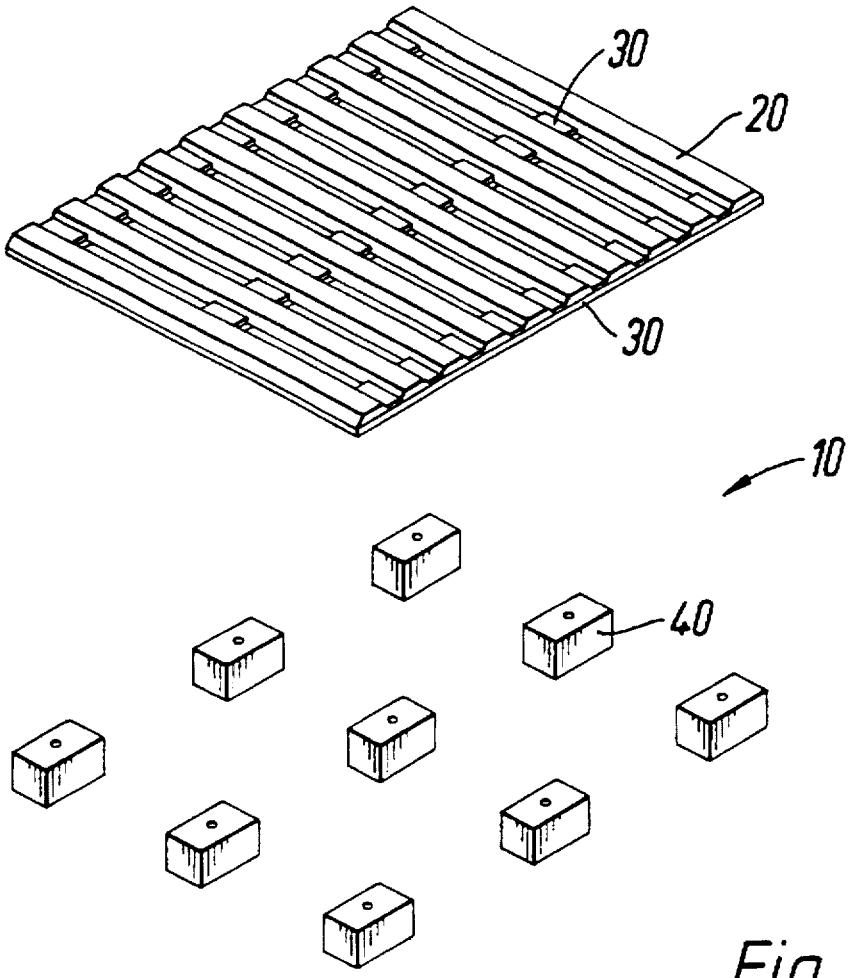
Fig. 1
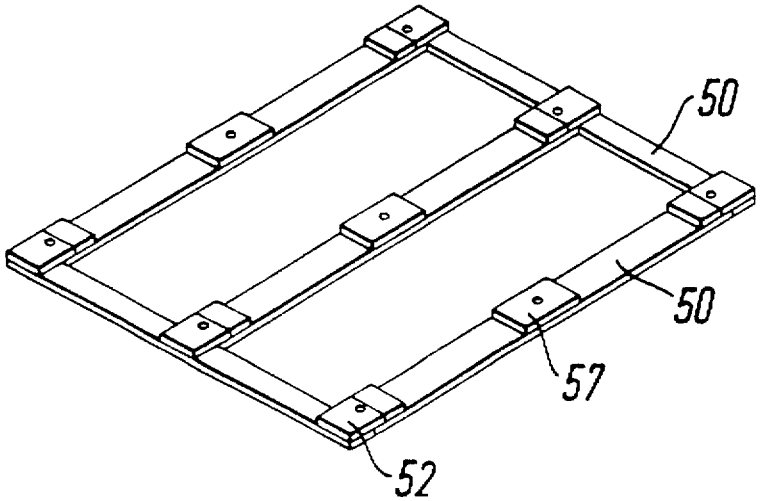

LOAD-HANDLING PALLET AND METHOD OF ASSEMBLY

The present invention relates to a load-handling pallet for use with fork-lift trucks and to a method of assembly thereof.

Conventionally, load-handling pallets are made of wood. However, these are unsuitable for use with foodstuffs as they are unhygienic. To overcome this problem, pallets made from injection moulded plastics have been used but they have the disadvantage that they are expensive to manufacture owing to the high tooling costs involved. One such pallet is described in GB 1575143.

The present invention seeks to provide a pallet made from a hygienic material which overcomes or substantially mitigates the aforementioned disadvantages.

International Patent Application No. 91/13810 discloses a load handling pallet comprising plastics elements defining an upper load-bearing platform with cross-members and supporting blocks. The elements are secured together by bolts with abutments which project beyond both major surfaces of the pallet. The disclosure of this document corresponds to the preamble of claim 1. U.S. Pat. No. 5,197,396 also discloses a pallet comprising releasably-connected plastics elements.

According to the present invention there is provided a load-handling pallet comprising a plurality of separate plastics elements defining at least an upper load-bearing platform with at least two parallel cross members therebeneath and at least four blocks for location at the corners of the platforms, which together with the cross members define spaces between which the forks of a fork-lift truck can be located, characterised in that said plastics elements are releasably connected together by means of connection elements which, starting from the lower surface of the pallet, extend through said blocks and into said cross members, or location elements integral therewith, but terminate before they reach the upper surface of the pallet.

An advantage of the above arrangement is that the pallet can be dismantled for cleaning and repair, and individual elements can be separately replaced if damaged without the need for the whole pallet to be discarded. Also the components may be transported in compact kit form before assembly, thus saving space and thus transport costs.

In one preferred embodiment of the invention the platform is constituted by a plurality of parallel top boards which are supported on three stringers perpendicular thereto and nine support blocks, to the bottom of which are in turn attached five base boards. The top boards have bevelled sides which engage in corresponding dovetail grooves in the stringers. The stringers have plastics locator elements fixedly attached thereto which engage with respective upper parts of the support blocks. The base boards also have plastics locator elements fixedly attached thereto. Different types of locator element are provided depending on their positions on the base board. Six end locator elements are arranged in two parts which are arranged on different base boards but which are arranged to interengage before being engaged with respective lower parts of the support blocks. Three one-piece locator elements, similar to those on the stringers, are arranged centrally on three of the base boards. The various interconnections may be supplemented by screw, bolt or other connection elements.

Preferably, the plastics elements are made from polyvinyl chloride (PVC) or polypropylene (PP). This means that the pallet can be dismantled and washed down and disinfected to comply with the rigorous regulations governing the transportation and handling of foodstuffs. The elements are extruded components which are cut to appropriate length to construct the pallet. Some or all of the components, especially the support blocks, may be injection-moulded.

In another embodiment of the invention the plurality of separate plastics elements are connected together predominantly by rustless steel self-locking type bolts or screws located within the central cellular cavities of the upper load-bearing platform boards fixed to purpose-made pre-drilled and threaded stainless steel or polypropylene (PP) elongated locating and fixing straps placed within the centre cavities of each of the upper load-bearing platform boards. The locating straps accommodate a plurality of separate bolts or screws. Alternatively each of the upper load bearing boards may have the central cavities extruded with a solid centre core to accommodate self tapping rustless steel screws or be pre-tapped for rustless steel bolts. The two outer cells of all the upper load bearing platform boards including the supporting stringers may be independently reinforced within themselves by the introduction of purpose made resin bonded "rot-proof" laminated "H section" purpose-designed timber inserts placed in the outer cavities; alternatively polypropylene (PP) inserts can be used and placed within the outer cavities of the cellular load bearing platform boards along with stringer support members therebeneath, under which the forks of a fork lift truck can be located.

The outer corners of the blocks and upper platform boards may be fitted with impact resistant rubber closure caps or alternatively polypropylene cellular board end closure caps may be used.

The blocks are hollow and made by an injection-moulded process. These are secured to the stringer support members by fixing through the sides of the blocks into a plastic locating pad or insert pre-fixed to receive the blocks.

These purpose-designed locating pads serve a dual purpose by allowing positive anchorage of the whole pallet, They also prevent any distortion and keep the pallets true and square when in use. They also allow fast accurate manufacturing of the pallets by use of multi-head robotic machines, facilitating line production methods.

Preferably also, the elements comprise five additional blocks, four located centrally of each of the sides of the pallet respectively between the corner blocks, with the fifth one located at the centre of the pallet. A third cross-member, which is parallel to the other two cross-members and connected to the fifth block and two of the additional four blocks, supports the central region of the top boards. All blocks are fixed to the base boards by rustless fixings direct through and secreted in the foot of the block which, when pallet assembly is completed, creates a bacteria free product allowing easy cleaning.

Preferably also plastic base boards are provided beneath the blocks fixed to the underside of the pallet.

A preferred embodiment of the present invention will now be described, by way of example only, with reference to the accompanying drawings of which:

FIG. 1 is a partially exploded schematic view of a pallet according to a first embodiment of the present invention;

Figure 2:
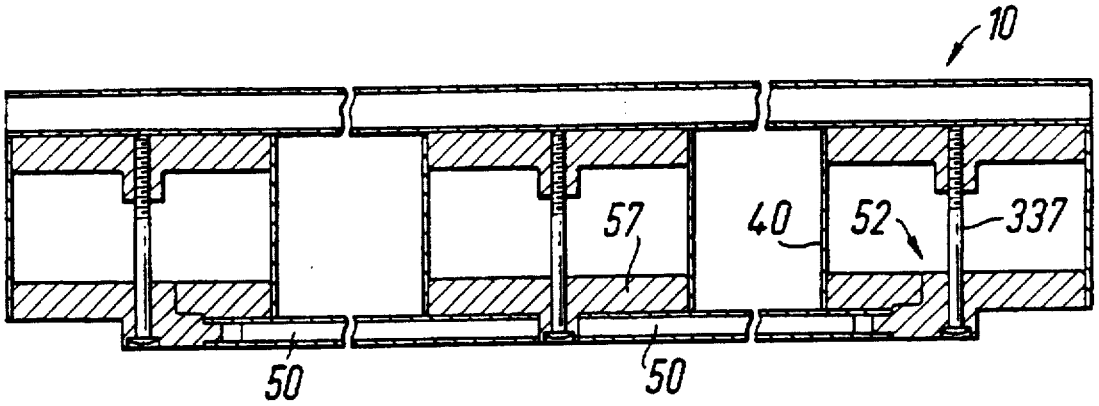
FIG. 2 is an enlarged sectional view of the pallet of FIG. 1.

Referring to the drawings, FIG. 1 shows a pallet 10 in accordance with the first embodiment comprising a plurality of top boards 20 attached to three top stringers 30. The top boards form a load-bearing platform. The stringers are attached to nine blocks 40 to which are attached five base boards 50.

The stringers have integral locator elements 32 which engage in the open tops of blocks 40. Locator elements 52, 57 integral with base boards 50 engage in the open bottoms of blocks 40. The top and bottom locator elements, and hence the top and bottom decks of the pallet 10, are interconnected via connection elements, e.g. bolts 337.

Locator elements 52 will be described in further detail in connection with the embodiment of FIG. 9. However, it should be noted here that locator elements 52 are in two parts 53, 54 and that, for extra strength, part 53 has fingers 153 which extend into the cavity of the next base board 50 which is integral with the other part 54.

Figure 3:
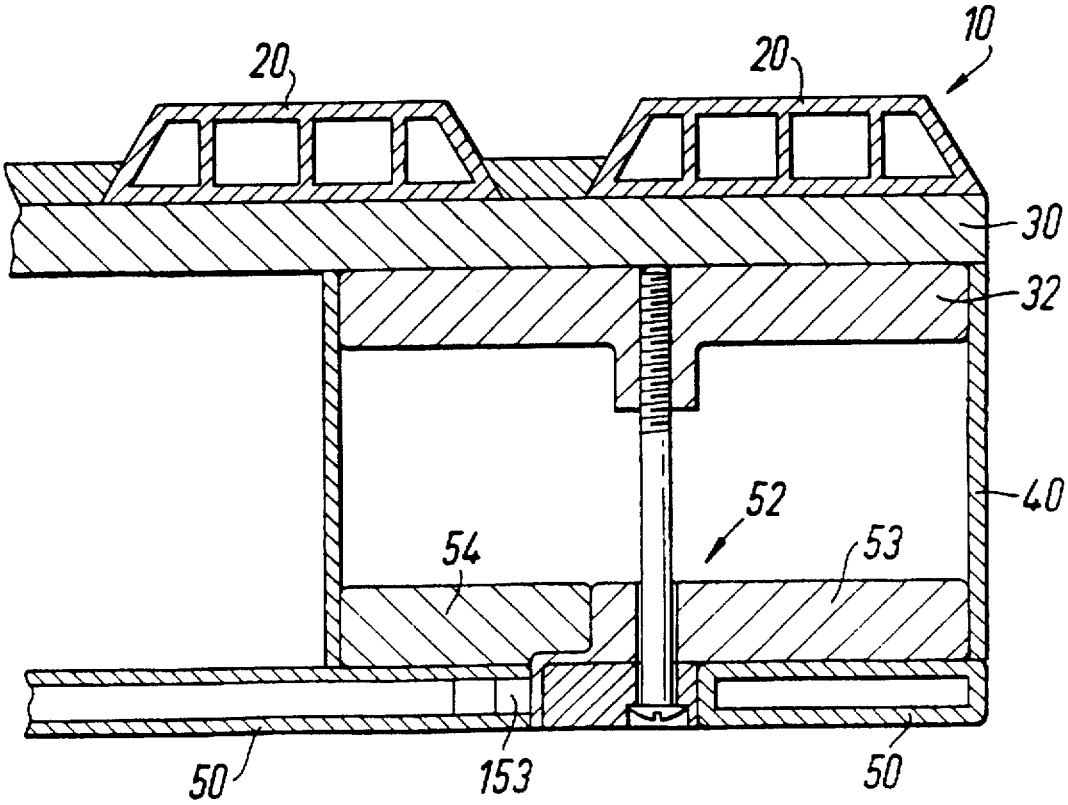
FIG. 3 is a further enlarged sectional view of the pallets FIGS. 1 and 2.
Figure 4:
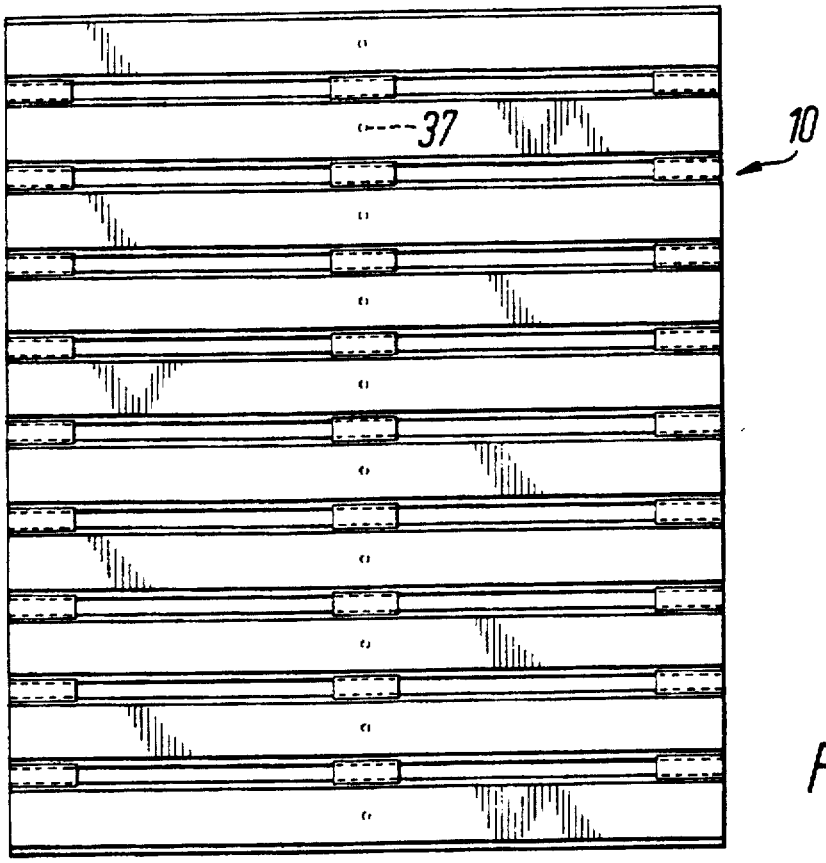
FIG. 4 is a top plan view of the pallet of FIG. 1.

FIG. 3 shows how the top boards 20 have bevelled edges which slide into corresponding dovetail grooves 31 in the top of the stringers 30. Each board is secured to the central stringer 30 by means of a rustless screw, pin or bolt connection element 37, FIG. 4 which is positioned from underneath during assembly. By disconnecting the respective element 37, an individual top board 20 may be slid out of its grooves 31 for repair, replacement or cleaning. Extra measures may be necessary for removing the end ones of the boards 20.

FIGS. 5 to 11 show a pallet 510 in accordance with a second embodiment of the present invention.

Figure 7:
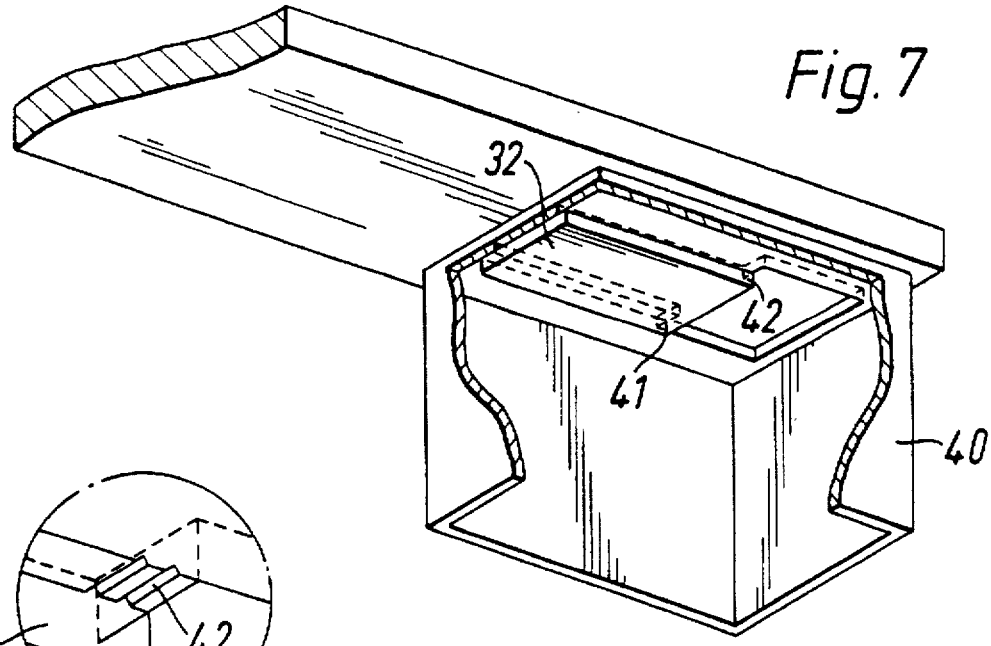
FIG. 7 is an enlarged, perspective and partly-sectioned view of the connection between a top stringer element and a block of the pallet of FIG. 5.
Figure 8:
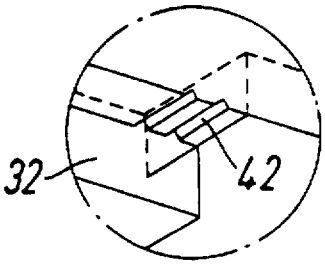
FIG. 8 is a further enlarged view of part of FIG. 7.
Figure 10:
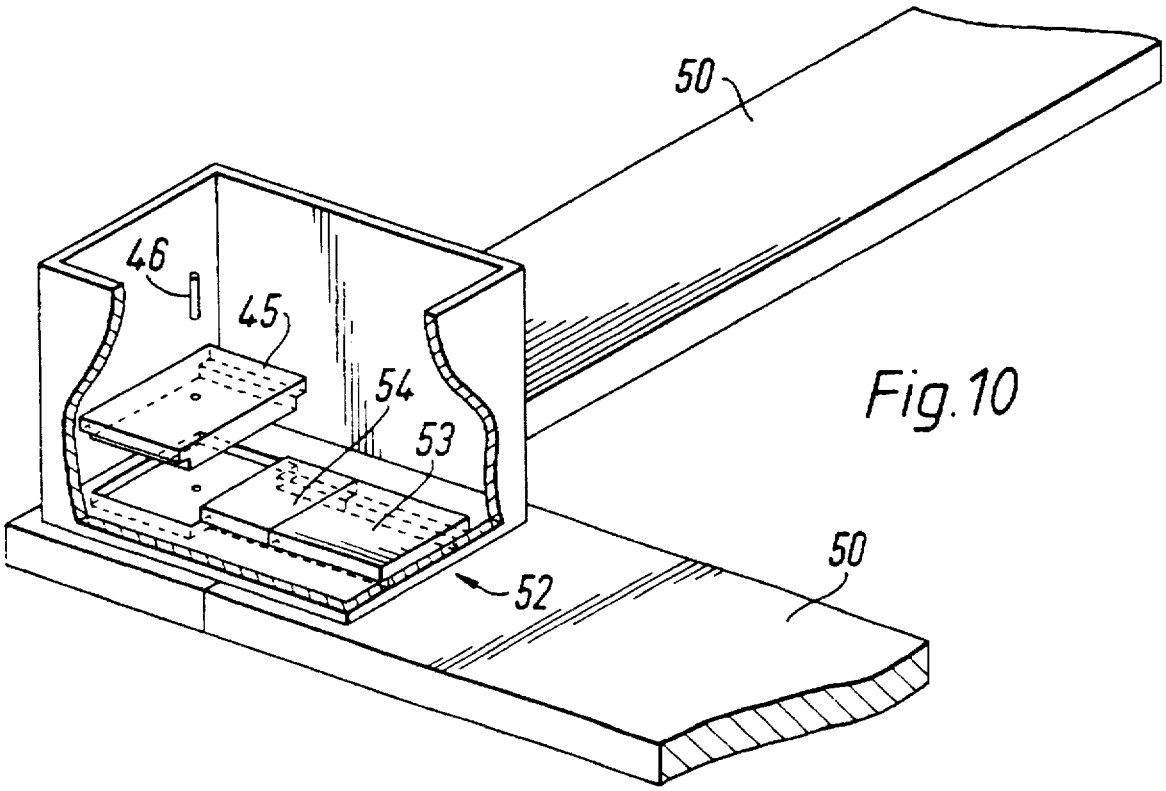
FIG. 10 is an enlarged, perspective and partly-sectioned view of the connection between two base boards and a block of the pallet of FIG. 5.

The connection between a stringer 30 and a block 40 is shown in FIG. 7. At the location of the blocks 40, the stringers have welded, adhered or otherwise fixed thereto substantially rectangular locator members 32 which slide into and are retained by correspondingly shaped recesses 41 in the top of the blocks. The locator members 32 engage corresponding stop surfaces in the recesses to ensure precise positioning. The interconnection is protected against inadvertent disconnection by a ratchet arrangement 42, an enlarged view of which is shown in FIG. 8.

The above arrangement means that for repair, replacement or cleaning purposes, the entire top deck, comprising board 20 and stringers 30, can be removed by simultaneously sliding all nine locator members 32 out of their corresponding recesses 41.

Figure 9:
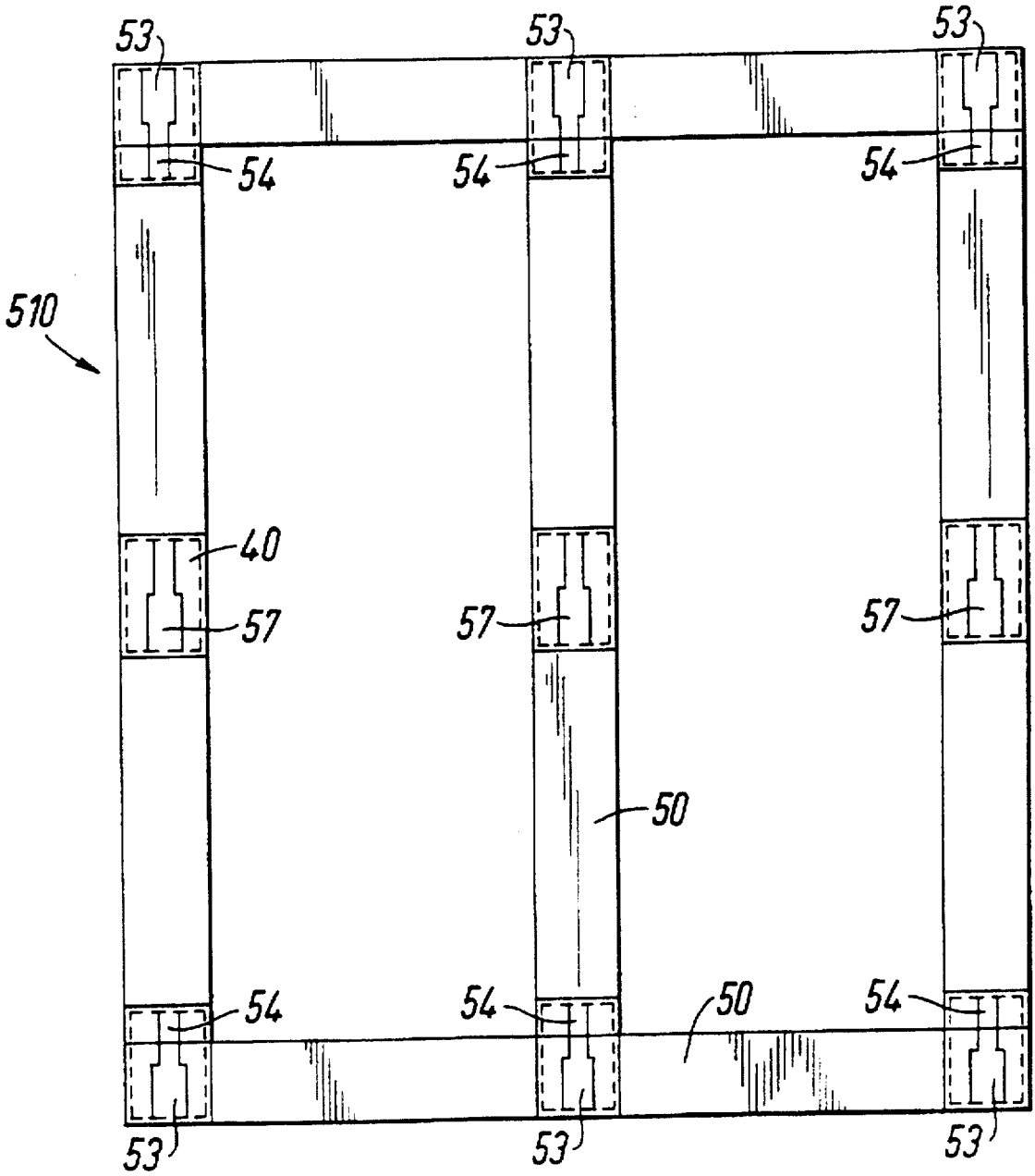
FIG. 9 is an underneath view of the base boards of the pallet of FIG. 5.

FIG. 9 shows an underneath plan view of the connection between the five base boards 50 and the nine blocks 40. As shown more clearly in the enlarged sectioned view of FIG. 10, the base boards also comprise locator members 52 fixed thereto. As shown in FIG. 9, these members 52 are made up of two interengaging members 53, 54, three members 53 being integral with each of the two end boards 50 and two members 54 being integral with each of the three transverse boards 50. After interconnection of the two base boards 50 by interengaging members 53, 54, a block 40 is attached thereto by means of a clamping piece 45 secured by a locking pin 46.

Three further locator members 57 are one-piece members similar to locator members 32 and integral with the transverse boards 50 at a central region thereof.

Figure 11:
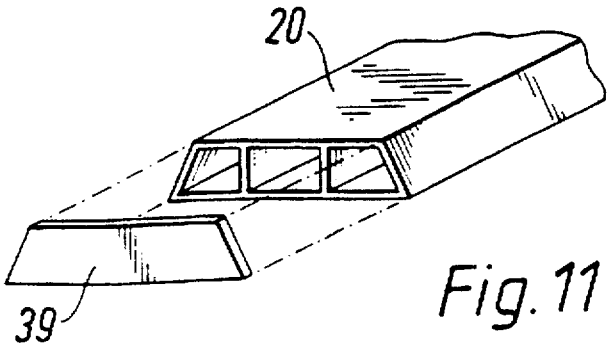
FIG. 11 is an enlarged, exploded view of the end of a top board of the pallet.

The top boards 20, stringers 30 and base boards 50 are all extruded components and are preferably provided with end caps such as 39, FIG. 11 which after location are bonded into position to create hermetically sealed components preventing the ingress of bacteria.

The blocks 40 are also hollow extruded components which are sealed around the locators 32, 52, 57 with a clear silicone vulcanising agent such as RTV 595 which hermetically seals the joints but allows assembly and dismantling of the pallet as required.

The above-described pallet has numerous advantages. It can be assembled, dismantled and repaired without the need for special tools, equipment or skilled labour. For repair purposes, only a limited number of different types of component need to be kept in stock.

Pallets of a varying range of sizes can be made from one set of extrusion dies; the extruded members are easily cut to the required length.

Pallets can be shipped in kit form for manual or automatic assembly by the user. The effective saving on space and transport costs is in the region of Various modifications can be made to the above described pallet. For example, the connections between the stringers 30 and the blocks 40 may be supplemented by locking pins etc; if so, these pins need to be removed before the top deck or platform can be removed as a single unit.

The central stringer 30 and/or the central base board 50 can be omitted if desired. In fact the base boards 50 can be omitted entirely. Of course additional elements may be provided if desired for larger or stronger pallets.

Figure 12:
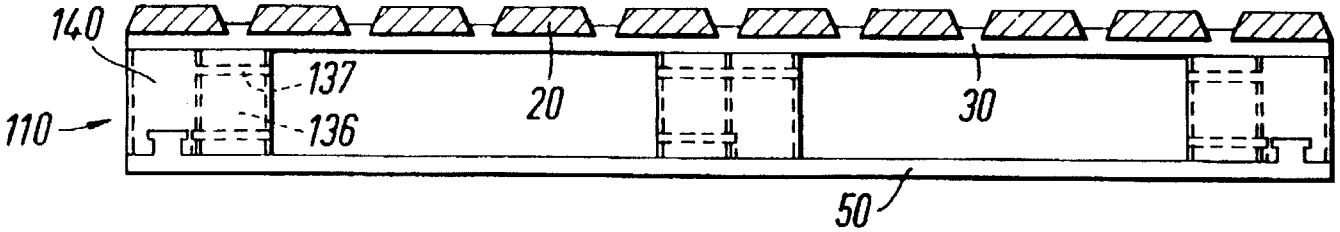
FIG. 12 is a cross-section of a pallet in accordance with a third embodiment of the present invention.
Figure 13:
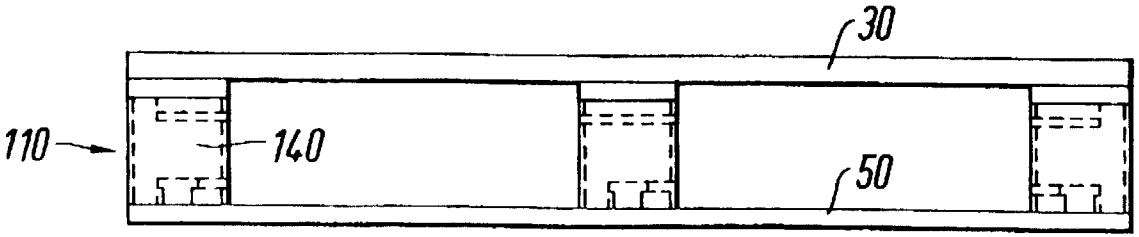
FIG. 13 is a cross-section of the pallet of FIG. 12 but perpendicular to the cross-section of FIG. 12.
Figure 14:
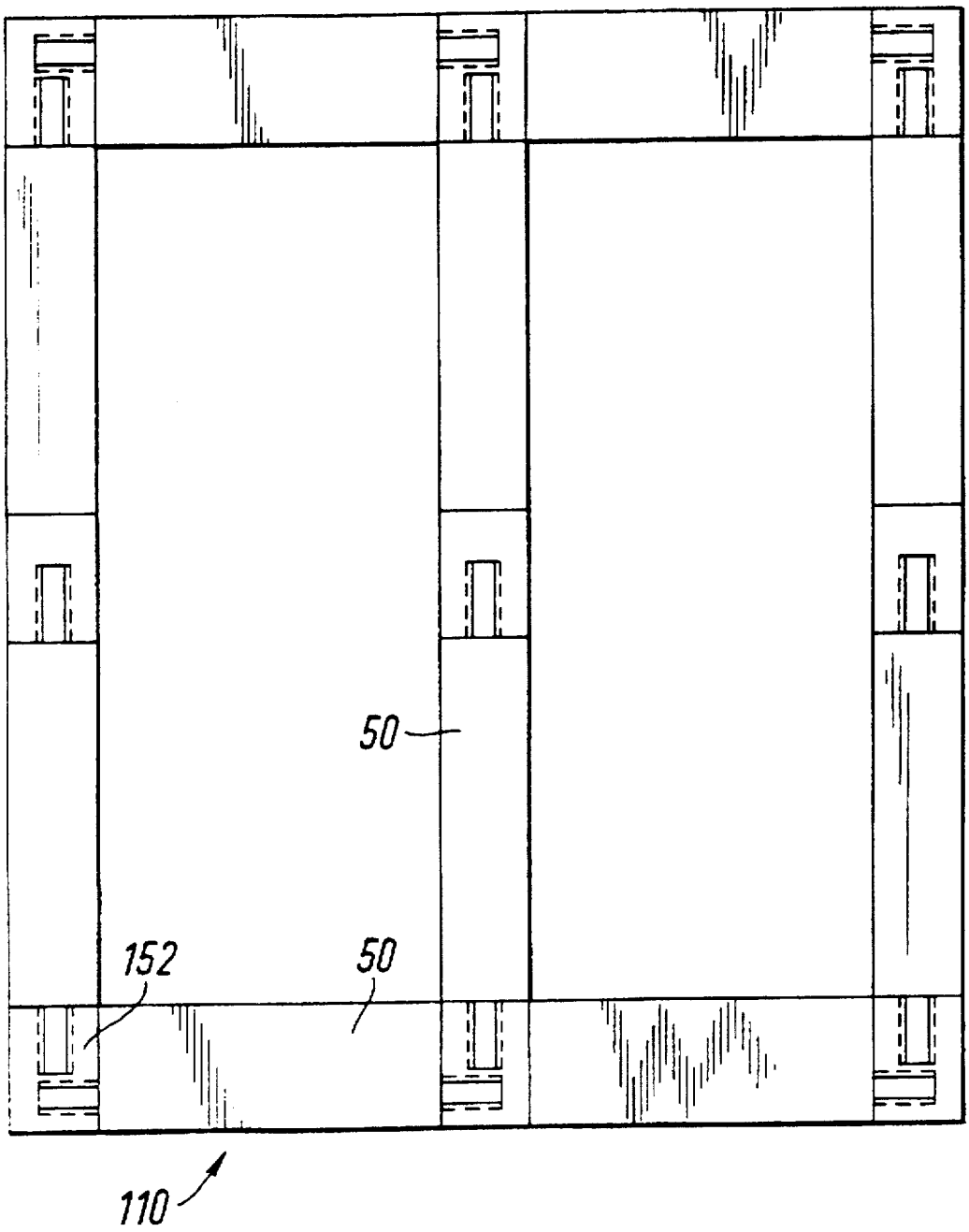
FIG. 14 is an underneath view of the base boards of the pallet of FIG. 12.

FIGS. 12 to 14 show a modified pallet 110 in accordance with a third embodiment of the invention in which blocks 140 are connected by transverse connection elements 137 to projections 136 integral with stringers 30. The bottom of blocks 140 are connected to the base boards 50 by right-angled locator elements 152. In pallets 110 the top deck or platform cannot be removed as a single unit, but the pallet is extremely robust, while still permitting the removal of individual elements, in particular top boards 20.

In another modification, not shown, the locator elements are circular in plan view and are connected to individual stringers and/or base boards, for example, by respective rotating triple-leg engagement means.

In all examples, the base boards 50 and the upper deck comprising top boards 20 and stringers 30 are secured to each other by rustless pins, bolts, screws or other connection elements passing through the block 40. These connection elements (not shown in FIGS. 5 to 14) can be fixed to pre-threaded stringer locator elements 32 to allow complete flexibility for removing individual components.

Figure 15:
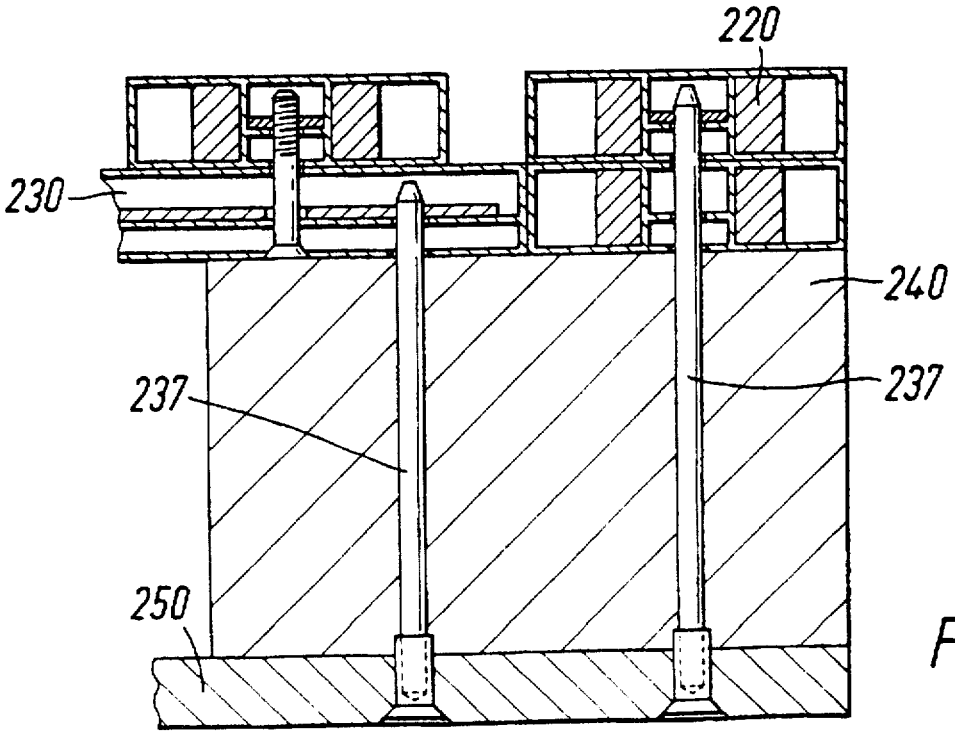
FIG. 15 is a cross-section of a pallet in accordance with a fourth embodiment of the present invention.
Figure 5:
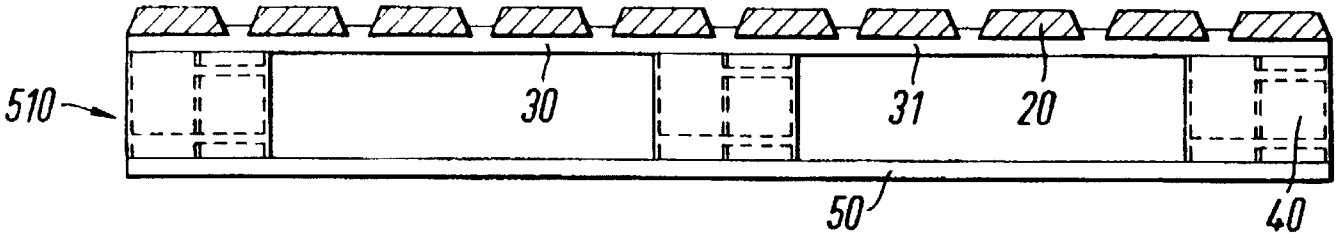
FIG. 5 is a cross-section of a pallet in accordance with a second embodiment of the present invention through the top boards thereof.
Figure 6:
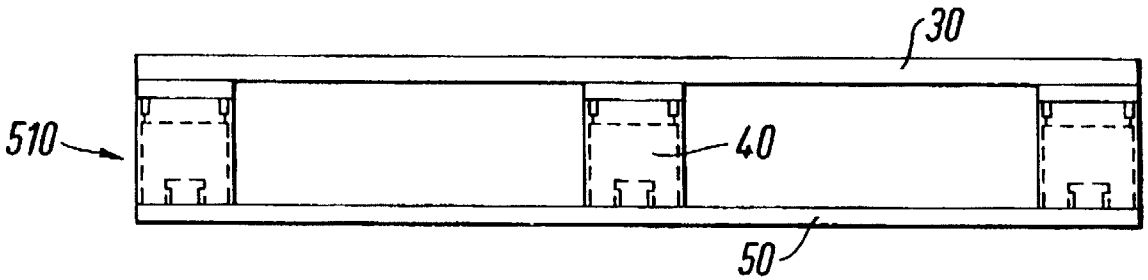
FIG. 6 is a cross-section perpendicular to that of FIG. 5.

FIG. 15 shows a fourth embodiment of the present invention with such an arrangement of connection elements. Screw bolts 237 fasten together base boards 250, stringers 230 and top boards 220 by means of a hollow or solid block 240.

Each of the above described embodiments can be modified as appropriate to incorporate one or more features of any of the other embodiments.

It is claimed:

1. A load-handling pallet comprising a plurality of separate plastics elements defining at least an upper load-bearing platform with at least two parallel cross members therebeneath and at least four blocks for location at the corners of the platforms, which together with the cross members define spaces between which the forks of a fork-lift truck can be located, said plastics elements being releasably connected together by means of connection elements which, starting from the lower surface of the pallet, extend through said blocks and into said cross members, or location elements integral therewith, but terminate before they reach the upper surface of the pallet and said cross members having integral locator elements which slidingly engage with corresponding means at the top of the blocks.

2. A pallet as claimed in claim 1, further comprising five additional blocks, four of which are located centrally of each of the sides of the pallet respectively between the corner blocks, and the fifth one of which is located at the centre of the pallet, and a third cross member which is parallel to the other two cross members and connected to the fifth additional block and two of the other four additional blocks to support the central regions of top boards forming the load bearing platform.

3. A pallet as claimed in claim 1, wherein base boards are provided beneath the blocks around the lower edge of the pallet.

4. A pallet as claimed in claim 3, wherein the base boards, have integral locator elements which are attached to the bottom of the blocks by means of attaching means.

5. A pallet according to claim 4, wherein at least some of the locator elements integral with the base boards comprise two parts each integral with a respective base board.

6. A pallet as claimed in claim 1, in which at least some of the plastics elements are secured together by separate connection elements.

7. A pallet as claimed in claim 1, in which the connection elements extend from the lower surface of the pallet through the said blocks in respective bores, and in which the said bores do not penetrate the upper surface of the pallet.

* * * * *

UNITED STATES PATENT AND TRADEMARK OFFICE

CERTIFICATE OF CORRECTION

PATENT NO. : 5,704,300

DATED : January 6, 1998

INVENTOR(S) : William Joseph Rushton (Deceased)

It is certified that error appears in the above-identified patent and that said Letters Patent is hereby corrected as shown below:

On the title page: Item [86]

please correct the § 371 Date to show: Dec. 8, 1995.

please correct the § 102(e) Date to show: Dec. 8, 1995.

Signed and Sealed this

Twenty-eighth Day of April, 1998

Bruce Lehman

*Attest:*

BRUCE LEHMAN

*Attesting Officer*

*Commissioner of Patents and Trademarks*